United States Patent [19]

Dunleavy, Jr.

[11] Patent Number: 4,512,651

[45] Date of Patent: Apr. 23, 1985

[54] COLLATING DOCUMENT FEEDER AND REPRODUCTION APPARATUS HAVING COPY DUPLEXING CAPABILITIES

[75] Inventor: James E. Dunleavy, Jr., Rochester, N.Y.

[73] Assignee: Eastman Kodak Company, Rochester, N.Y.

[21] Appl. No.: 813,041

[22] Filed: Jul. 5, 1977

[51] Int. Cl.[3] ..... B65H 3/06; B65H 5/26

[52] U.S. Cl. ..... 355/14 SH; 271/3.1; 271/65; 271/186; 355/23

[58] Field of Search ..... 355/23, 26, 14, 14 SH, 355/3 R; 271/3.1, 3, 4, 65, 186, 5, 6, 7, 163

[56] References Cited

U.S. PATENT DOCUMENTS

| | | | |
|---|---|---|---|
| Re. 27,976 | 4/1974 | Sahley . | |
| T957,006 | 4/1977 | Reid et al. . | |
| 2,649,302 | 8/1953 | Johnson et al. . | |
| 2,822,172 | 2/1953 | Mayo et al. . | |
| 3,008,707 | 11/1961 | McGarvey . | |
| 3,222,057 | 12/1965 | Couri . | |
| 3,227,444 | 1/1966 | Egan | 271/65 |
| 3,318,212 | 5/1967 | Rubin . | |
| 3,408,140 | 10/1968 | Hemphill . | |
| 3,409,366 | 11/1968 | Hanson et al. . | |
| 3,416,791 | 12/1968 | Beckman et al. | 271/65 |
| 3,466,029 | 9/1969 | Jensen et al. . | |
| 3,476,382 | 11/1969 | Tregay et al. . | |
| 3,484,164 | 12/1969 | Byland . | |
| 3,506,347 | 4/1970 | Carlson . | |
| 3,536,398 | 10/1970 | Bhagat . | |
| 3,547,535 | 12/1970 | McLean et al. . | |
| 3,548,783 | 12/1970 | Knapp . | |
| 3,552,739 | 1/1971 | Roberts et al. | 271/4 |
| 3,556,511 | 1/1971 | Howard et al. | 271/4 |
| 3,556,512 | 1/1971 | Fackler | 271/4 |
| 3,615,129 | 10/1971 | Drawe et al. . | |
| 3,630,515 | 12/1971 | Knapp . | |
| 3,630,607 | 12/1971 | Korn et al. | 355/6 |
| 3,645,615 | 2/1972 | Spear | 271/9 X |
| 3,663,012 | 5/1972 | Van Den Honert . | |
| 3,671,118 | 6/1972 | Fantuzzo et al. . | |
| 3,672,765 | 6/1972 | Altmann | 355/24 |
| 3,675,999 | 7/1972 | Komori et al. | 355/8 |
| 3,687,541 | 8/1972 | Aser et al. | 355/14 |
| 3,697,171 | 10/1972 | Sullivan | 355/17 |
| 3,709,595 | 1/1973 | Turner et al. | 355/14 |
| 3,719,266 | 3/1973 | Korn et al. | 214/65 X |
| 3,768,803 | 10/1973 | Stange . | |
| 3,770,348 | 11/1973 | Martin . | |
| 3,775,102 | 11/1973 | Punnett | 355/17 X |
| 3,799,537 | 3/1974 | Cobb | 271/3 |
| 3,844,653 | 10/1974 | Kelly | 355/8 |

(List continued on next page.)

FOREIGN PATENT DOCUMENTS 1494236 12/1977 United Kingdom .

OTHER PUBLICATIONS

"Document Feeder", *Research Disclosure,* Publication No. 13,329, vol. 133, p. 21, May 1975.

"Electrophotographic Copying Apparatus . . . ", *Research Disclosure,* Publication No. 14,237, vol. 142, pp. 38–40, Feb. 1976.

(List continued on next page.)

*Primary Examiner*—Bruce H. Stoner, Jr.
*Assistant Examiner*—James E. Barlow
*Attorney, Agent, or Firm*—G. Herman Childress

[57] ABSTRACT

Reproduction apparatus for producing duplex collated copies from duplex and simplex original documents. A document feeding section circulates original document sheets a plurality of times to an exposure position. In a duplex mode of operation, the originals are inverted between alternative odd and even circulations such that even pages are presented for exposure on the first and every subsequent odd circulation and odd pages are presented for exposure on the second and every subsequent even circulation. In a simplex mode of operation, the pages are copied selectively, even pages on odd circulations, and the odd pages on even circulations. A duplexing section of the copier, including a first-in first-out intermediate hopper, operates in coordination with the feeding section to present and re-present copy supports to a position for receiving images on the appropriate first and second faces of the copy supports.

15 Claims, 8 Drawing Figures

U.S. PATENT DOCUMENTS

| | | | |
|---|---|---|---|
| 3,844,654 | 10/1974 | Guenther . | |
| 3,856,295 | 12/1974 | Looney | 271/65 |
| 3,862,802 | 1/1975 | Till | 271/3 X |
| 3,866,904 | 2/1975 | Stemmle | 271/173 |
| 3,869,202 | 3/1975 | Tabata et al. | 355/3 R |
| 3,888,579 | 6/1975 | Rodek et al. . | |
| 3,900,192 | 8/1975 | Gibson . | |
| 3,913,906 | 10/1975 | Vits | 271/65 X |
| 3,937,454 | 2/1976 | Colwill . | |
| 3,937,454 | 2/1976 | Colwill | 271/3.1 X |
| 3,942,785 | 3/1976 | Stange . | |
| 3,947,270 | 3/1976 | North | 355/3 R X |
| 3,963,339 | 6/1976 | Taylor et al. . | |
| 3,963,345 | 6/1976 | Stemmk et al. . | |
| 3,980,406 | 9/1976 | Lang | 355/24 |
| 3,997,263 | 12/1976 | Stemmle | 355/24 |
| 4,040,616 | 8/1977 | Clarkson et al. . | |
| 4,043,550 | 8/1977 | Phillips et al. | 271/233 |
| 4,062,061 | 12/1977 | Batchelor et al. . | |
| 4,078,786 | 3/1978 | Stange . | |
| 4,078,787 | 3/1978 | Burlew et al. | 271/3.1 |
| 4,089,515 | 5/1978 | Stange et al. | 271/3 |
| 4,099,150 | 7/1978 | Connin . | |
| 4,099,254 | 7/1978 | Andrews et al. . | |
| 4,109,903 | 8/1978 | Stange et al. . | |
| 4,116,558 | 9/1978 | Adamek et al. . | |
| 4,140,387 | 2/1979 | Gustafson | 355/14 |
| 4,146,219 | 3/1979 | Phillips | 271/233 |
| 4,158,500 | 6/1979 | Di Francesco et al. | 355/14 |
| 4,169,674 | 10/1979 | Russel | 355/14 |
| 4,229,101 | 10/1980 | Hamlin et al. . | |

OTHER PUBLICATIONS

"Apparatus for Producing Collated Copies . . . ", *Research Disclosure,* Publication No. 15,766, vol. 157, pp. 77–79, May 1977.

"Apparatus for Producing Duplex Collated Copies", *Research Disclosure,* Publication No. 14,927, vol. 149, pp. 18–20, Sep. 1976.

"Apparatus for Producing Collated Copies in Page Sequential Order", *Research Disclosure,* Publication No. 15,671, vol. 156, pp. 80–82, Apr. 1977.

Rept. No. 14607, "Automatic Control . . . ", *Research Disclosure,* Ind. Opp. Ltd., Havant, Hampshire, U.K., No. 146, Jun. 1976, pp. 19–22.

Rept. No. 16332, "Collating Document Feeder . . . ", *Research Disclosure,* Ind. Opp. Ltd., Havant, Hampshire, U.K., Nov. 1977, pp. 49–52.

Bullock, M. K., "Duplex Document Feeder", *IBM Technical Disclosure Bulletin,* vol. 19, No. 12, May 1977, p. 4496.

Rogers, J. C. et al., "Document Feed", *IBM Technical Disclosure Bulletin,* vol. 14, No. 5, Oct. 1971, p. 1547.

COLLATING DOCUMENT FEEDER AND REPRODUCTION APPARATUS HAVING COPY DUPLEXING CAPABILITIES

CROSS-REFERENCE TO RELATED APPLICATIONS

Reference is made to commonly assigned copending U.S. patent applications, Ser. No. 691,938, entitled Apparatus for Producing Collated Copies from Two-sided Originals, filed in the name of G. B. Gustafson on June 1, 1976, a continuation of such application having been filed as Ser. No. 867,842 on Jan. 9, 1978, now U.S. Pat. No. 4,140,387, issued Feb. 20, 1979; Ser. No. 691,937, entitled Apparatus for Producing Duplex Collated Copies, filed in the name of J. Connin also on June 1, 1976, now U.S. Pat. No. 4,099,150, issued July 4, 1978; and Ser. No. 768,666, entitled Apparatus for Producing Duplex Collated Copies in Page Sequential Order, filed in the names of A. B. Di Francesco and C. T. Hage on Feb. 14, 1977, a continuation of such application having been filed as Ser. No. 901,922 on May 1, 1978, now U.S. Pat. No. 4,158,500, issued June 19, 1979.

BACKGROUND OF THE INVENTION

The present invention relates to reproduction apparatus having copy-collating and duplexing capabilities. More specifically, the invention relates to copiers having collating document feeders and copy duplexing sections which are coordinated in operation to produce collated duplex copies from duplex and simplex originals.

The art of document handling is well developed for generating simplex copies from simplex originals. Numerous and rather sophisticated features exist, including, for example, document feeding in a sequence which automatically collates the final copies without a sorter. An especially advantageous collating document feeder is disclosed in commonly assigned copending U.S. patent application, Ser. No. 647,683, entitled Recirculating Sheet Feeder, filed on Jan. 8, 1976, in the name of Matthew Russell, such application being a continuation of application Ser. No. 523,610 filed Nov. 13, 1974, now U.S. Pat. No. 4,169,674, issued on Oct. 2, 1979.

The art of copy duplexing also is well developed for generating duplex copies from duplex originals. Examples include to so-called "single pass" approach, which establishes copy images in sequence on alternate faces of a copy support, and "double pass" approach, which uses an intermediate hopper to collect copy sheets after they receive images on one face and then refeeds the collected sheets to receive images on the alternate face. Single pass approaches are disclosed in U.S. Pat. Nos. 3,672,765, 3,869,202, and 3,947,270. Double pass approaches are disclosed in the February 1976 issue of Research Disclosure, Vol. 142, No. 14237 at page 38 (published by Industrial Opportunities Ltd., Homewell Havant, Hampshire, P09 1EF, United Kingdom), and in U.S. Pat. No. 3,719,266.

More recently, there have been attempts to combine the arts of copy collating and duplexing in convenience copiers without sorters. U.S. Pat. No. 3,630,607, is exemplary in its disclosure of copying apparatus including a collating document feeder and a copy-duplexing section. The feeder circulates original document sheets a plurality of times to en exposure position in a manner suitable for collating the final copies. Both faces of a duplex original can be copied by manually turning the document over after all of the sheets are copied on one face. The duplexing section includes a top-feeding intermediate hopper and a "double pass" paper path for inverting the copy supports and presenting both faces of the supports for receiving copy images.

Prior art approaches such as those referred to above, which have both collating and duplexing capability, are not entirely automatic in operation. Although it might appear on first impression that automation could be accomplished without too much difficulty, undesirable problems remain with the obvious solutions. In prior double pass approaches, for example, the first completed copy cannot be delivered until all of the copies receive images on their first face. Only then does any copy receive an image on its second face.

Other particularly perplexing problems are encountered when additional features are contemplated in fully automated apparatus. Prior art methods of producing duplex copies from simplex originals, for example, may require separation of the original into odd-page and even-page sets, so the odd pages can be copied on ascending order and the even pages in descending order.

The cross-referenced patent applications cite additional prior art approaches and offer solutions to many of the problems. The present invention is directed to these same problems, but offers a unique solution possessing its own further advantages which are not available from the teachings of the prior art.

SUMMARY OF THE INVENTION

In accordance with the present invention, significantly improved reproduction apparatus can be provided having fully automated duplexing and collating capabilities. The advantages of page-sequential copying are closely approximated while the necessary handling of the original document sheets is reduced. Simplex-to-duplex copying is facilitated, without requiring document separation into odd-page and even-page sets, and collation is accomplished without a sorter.

According to the preferred embodiment, a document feeder is provided for circulating the set of original document sheets a plurality of times to an exposure position, and for inverting the originals between alternative circulations, to present one face of the document sheets for exposure on the first and every subsequent odd circulation and the other face of the document sheet on the second and every subsequent even circulation. A duplexing section of the copier, which includes a first-in first-out intermediate hopper, operates in conjunction with the feeder to present and represent copy supports to a position for receiving images representing the respective faces of the originals on the first and second faces of the supports.

More specifically, the feeder is provided with alternative transport paths leading from a hopper to an exposure position. One path is used for duplex-to-duplex copying, and inverts the original document sheets zero or an even number of times between the hopper and the exposure position. The other is for simplex-to-duplex copying, and inverts the sheets one or an odd number of times. The alternative paths facilitate the copying of simplex and duplex originals. The duplexing section preferably employs only a single mode of operation for all duplex operations, but may have an additional mode for simplex copies.

Still other aspects and more specific features will become apparent to those skilled in the art from the following description with reference to the accompanying drawings.

DESCRIPTION OF THE PREFERRED EMBODIMENT

Figure 1:
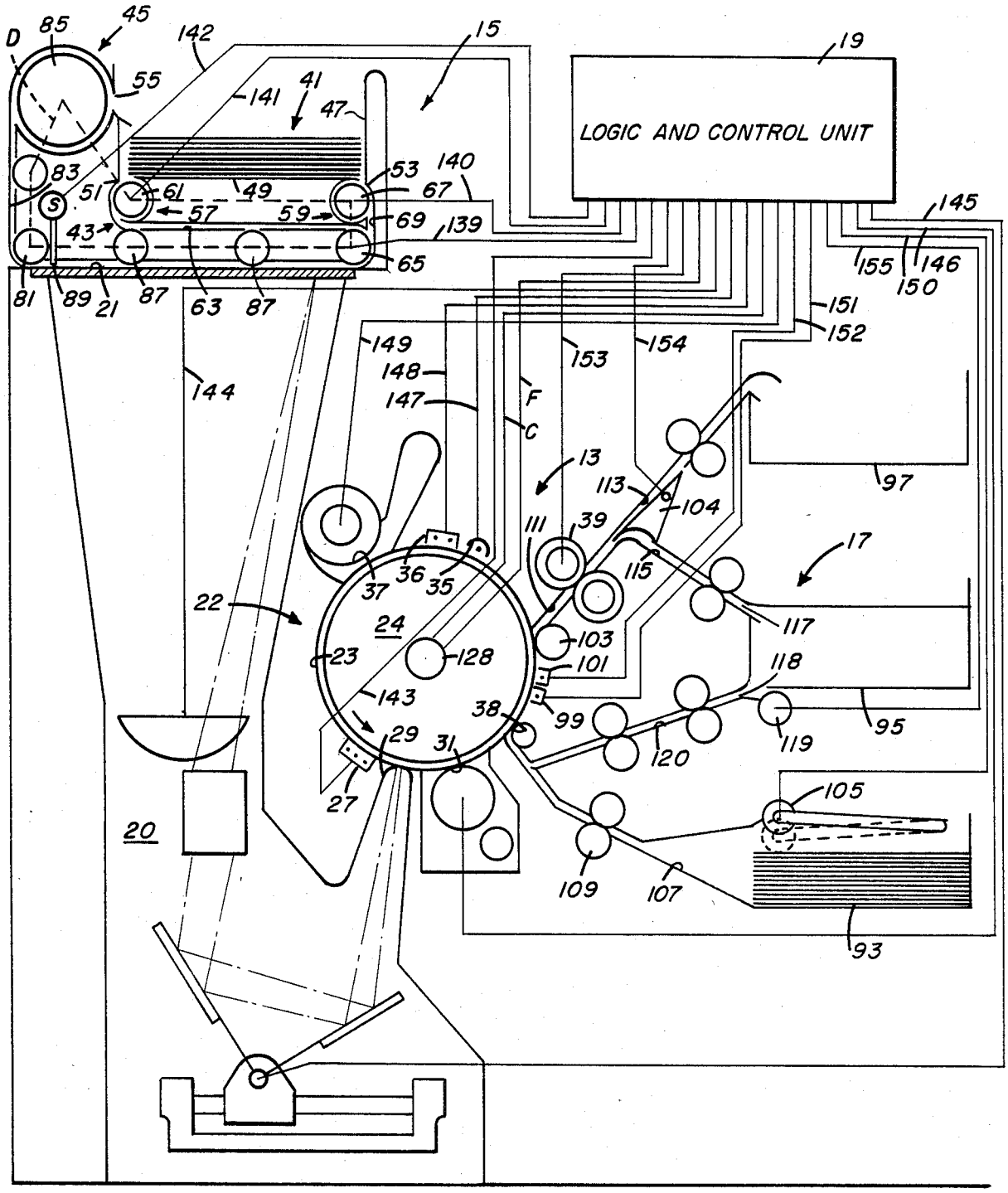
FIG. 1 is a schematic representation of a convenience copier having duplexing capabilities and including a collating, inverting document feeder and a copy duplexing section in accordance with a preferred embodiment of the present invention.

Referring now to the drawings, and particularly to FIG. 1, a convenience copier is depicted in accordance with a preferred embodiment of the present invention, comprising a process section 13, a document feeding section 15, a copy duplexing section 17, and a logic and control unit 19.

The document feeding section is adapted to receive a set of original document sheets; to deliver the sheets one-after-another to the process section; and to return the sheets to the original set, each sheet on top of previously delivered sheets. As will become more apparent hereinafter, this permits copying of the sheets in a sequence that collates the final copies without a sorter. It also maintains the page-sequential order of the original document. In a duplex-to-duplex mode of operation, the feeding section inverts or turns each respective sheet over between its successive deliveries so that both alternative faces of the sheets will be copied. Again, this is accomplished in a manner that collates the copies without disturbing the original document order.

The process section views the original sheets presented by the feeding section and establishes visible representations thereof, typically as image-wise distributions of marking particles which are transferrable to supports such as paper. In a simplex-to-duplex mode of operation, the original sheets are copied selectively, i.e. every other sheet on one presentation and those not previously copied on the next successive presentation, so that the images will be transferred in proper relationship to the copy supports.

The duplexing section presents the copy supports to the process section for receiving the visible representations and forming the final copies. Each sheet is presented twice, once for receiving an image on each of its alternative faces. All of the sheets in one copy set are presented once before any sheet in that set is presented again, but the entire set is presented both times before the next successive copy set (assuming more than one copy) is presented either time.

The logic and control unit coordinates the operation of the three sections as required for their synchronous operation, and may coordinate operation of the copier with peripheral equipment such as finishers. While this unit will be described as a segregated part of the copier, it shall be apparent that it also could form part of one or more of the other sections.

Referring more specifically now to the drawings, each of the respective sections which comprise the preferred embodiment are described in more detail as follows.

Process Section (FIG. 1)

The process section 13 can be selected from suitable designs known to those skilled in the art, and a brief reference to its general configuration is considered sufficient for the purpose of the present specification. A scan/drum arrangement is depicted in which an imaging device 20 includes scanning optical and illumination mechanisms for viewing originals placed on transparent platen 21, while a processor 22 includes a photoconductor 23 supported on a drum 24 for movement in a cylindrical or closed path.

As the photoconductor moves in its path, it is acted upon by various processing stations. Proceeding counterclockwise, in the direction of drum rotation, the photoconductor is sensitized by a corona charger at station 27, is exposed by the imaging device at station 29, is developed by a magnetic brush at a station 31, moves through corona transfer and detack stations to be described hereinafter, is erased by illuminators and corona chargers at stations 35 and 36 respectively, and is cleaned by a vacuum brush or the like at station 37. Two additional stations 38 and 29 are spaced from the photoconductor in a copy duplexing path. These stations include a registration device and fuser, respectively.

In operation, the imaging device 20 sequentially scans the images from successive original sheets onto successive frames along the photoconductor, where visible representations of the original sheets are established as image-wise distributions of marking particles, which successively are transferable to copy sheets. A further description of the above-mentioned stations, and the imaging device, is presented in an article entitled Optical Scanning Apparatus for Copying Machines, disclosed by A. B. Zanolli and C. T. Hage on pages 32–34 of Volume 141 (January 1976 edition) of Research Disclosure, published by Industrial Opportunities Ltd. Homewell Havant. Hampshire, P09 1EF, United Kingdom, the disclosure of which hereby is incorporated herein by reference.

Other arrangements of process sections that could be modified to practice the invention in accordance with the teachings of the present specification are disclosed in U.S. Pat. Nos. 3,914,047 entitled Synchronizing Control Apparatus for Electrophotographic Apparatus Utilizing Digital Computer, issued on Oct. 21, 1975 in the name of William E. Hunt et al; and 3,876,106 entitled Toner Concentration Monitoring Apparatus Utilizing Programmable Digital Computer, issued on Apr. 8, 1975 in the name of Stephen R. Powell et al. These last-mentioned patents disclose copiers of the so-called flash/web type.

Document Feeding Section (FIGS. 1, and 3–8)

The feeding section 15 includes a document supporting portion 41, a sheet feeding portion 43, and a sheet-returning portion 45.

The supporting portion is adapted to receive the set of original sheets face-up in normal page-sequential order and to deliver the sheets successively, last or bottom-most sheet first, to the feeding portion. It also receives sheets delivered by the returning portion and directs the returned sheets onto the set with each sheet on top of previously returned sheets. The supporting portion includes a hopper 47 having a floor or supporting tray 49 and two opposed exit slots 51 and 53 at opposite ends of the hopper. As will become more apparent hereinafter, the sheets are delivered through a selected one of these exits depending upon the mode of operation. The exit 51 is employed in a duplex-to-duplex mode; the exit 53 in a simplex to duplex mode. An entrance 55 adjacent one end at the top of the hopper also is provided for receiving the sheets. In this embodiment, the hopper is spaced above the exposure position where it is readily accessible for receiving and supporting the set of original sheets. Further details of the preferred hopper are illustrated and described in the previously-mentioned copending U.S. Pat. No. 4,169,674, which is incorporated herein by reference.

The sheet-feeding portion 43 includes first and second sheet transporting paths 57 and 59, and associated propelling means, alternately selectable for directing sheets from the hopper to the exposure position. Path 57 is employed in the duplex-to-duplex mode and leads from exit 51 around roller 61, along reach 63 around roller 65 and onto the platen 21 in the exposure position. It should be noted that a sheet removed from the hopper and delivered to the exposure position along this path is inverted twice so that its facing orientation on the platen will be the same as it was in the hopper. A path of zero or any even number of inversions would accomplish the same function. Path 59 is employed in the simplex-to-duplex and simplex-to-simplex modes and leads from exit 53 around roller 67, along reach 69, around roller 65 and onto the platen. A sheet following this path will be inverted only once (or an odd number of times) and will be delivered to the platen with its facing orientation reversed from what it was in the hopper. The sheet-removing means and guiding structure has not been described in detail, but can comprise a vacuum pick-off device at the rollers 61 and 67, and guiding channels at and between the reaches 63 and 69, generally as disclosed in the abovementioned U.S. Pat. No. 4,169,674.

The sheet-returning portion 45 includes a single sheet transporting path and associated propelling means leading from the exposure platen around roller 81, along reach 83, around roller 85 and into the hopper entrance 55.

The platen itself, which can be included in the feeding or the processing sections, is part of a sheet registration and exposure station including rollers 87 and a registration gate 89. On entering the exposure station, a document sheet is driven by the rollers 87 into a registered position against the gate. After the sheet is copied, the gate is removed via solenoid S and the rollers 87 drive the sheet into the returning portion 45.

Sometimes the feeder is referred to as a circulating or recirculating feeder because the sheets move in the feeder repeatedly from the hopper to the exposure platen and back to the hopper in a manner which simulates a closed-loop or circuitous path. It is a collating feeder because it is capable of feeding sheets in an appropriate sequence for producing collated copies without a sorter. It also is a duplexing feeder in the sense that it can feed original or document sheets in a manner suitable for generating duplex copies.

For the purposes of simplifying the description, it will be assumed throughout most of this specification that the feeder and copier are operating in a collating duplexing mode with a simplex or duplex original. It should be understood, however, that many of the feeder's advantages relate to its flexibility and convenience in other modes of operation. Such other modes might include capabilities for feeding without collating, and for generating simplex collated copies from simplex originals. In the non-collating mode, each page would be presented to the platen once regardless of the number of copies to be made. When making simplex, collated copies from simplex originals, on the other hand, the feeder would operate generally as described in the above mentioned U.S. Pat. No. 4,169,674.

Copy Duplexing Section (FIGS. 1 and 3–8)

The copy duplexing section includes one or more supply devices such as first hopper 93, an intermediate storage mechanism such as the second hopper 95, a completed-copy access station such as third hopper 97, the registration device 38, transfer and detacking coronas 99 and 101, respectively, a vacuum stripping roller 103, the fuser 39, a diverting finger 104, and various guiding channels and propelling rollers.

The supply device is adapted to receive a plurality of copy supports in hopper 93 and includes a scuff roller 105 or the like for feeding one-sheet-after-another from the hopper into the channel 107, between the rollers 109 and into the registration device 38.

Registration device 38 momentarily interrupts movement of the copy supports for their proper alignment with the appropriate image frame on the photoconductor, after which the sheets are directed into engagement with the photoconductor with the same relative velocity as the photoconductor.

The transfer corona 99 electrostatically tacks the copy supports from the registration device onto the photoconductor and transfers the visible representation, or image-wise distribution of marking particles, established by the previously described process section, from the photoconductor to the copy support. The detacking corona, of the A.C. variety, then eliminates the electrostatic forces tacking the copy support to the photoconductor and facilitates the removal of the copy support from the photoconductor with the visible image on the just removed face of the copy support.

Vacuum stripping roller 103 separates the detacked support from the photoconductor and directs the support along channel 111 into the fusing device 39, where the visible image is permanently fixed onto the copy support with pressure and heat. The stripper 103 has been depicted as a vacuum roller, but other appropriate means could be substituted therefor. In a copier employing a flexible web, for example, the web could be constrained to follow a short radius path, rapidly diverging from the plane of the copy support, to strip the support from the photoconductor without additional support-containing elements.

From the fuser the copy support can follow either of two channels or paths, 113 or 115, depending on the position of the diverter finger 104. In the case of a duplex mode of operation, after receiving an image on one face of the support, the diverter finger will be in a first position for directing the copy support into channel 115 and intermediate hopper 95. In the case of a simplex mode of operation, and on the second pass of the duplex mode, the diverter finger will be in a second position for directing the copy support into channel 113 and access hopper 97.

The intermediate hopper receives copy supports from a top entrance 117, each support on top of previously received supports, stores the supports until a complete copy set has been received, and then refeeds the supports out of the hopper through a bottom exit 118. Thus, the intermediate hopper operates to receive and refeed the sheets in a first-in first-out manner. Refeeding is accomplished by a vacuum feeder 119 or the like, which withdraws the supports from the hopper one-after-another and directs the supports along channel 120 for a second pass through the registration device and to the photoconductor. On this second pass, an image is received on the second face of the support, by a process which is like that used during the first pass, and the now duplex copy proceeds again through the detacking corona 101, the vacuum stripper 103, and the fusing device 39.

The exit hopper is of conventional design, and receives the copy supports with the last transferred image facing up, again with each support delivered to the hopper on top of previously delivered sheets.

Figure 2:
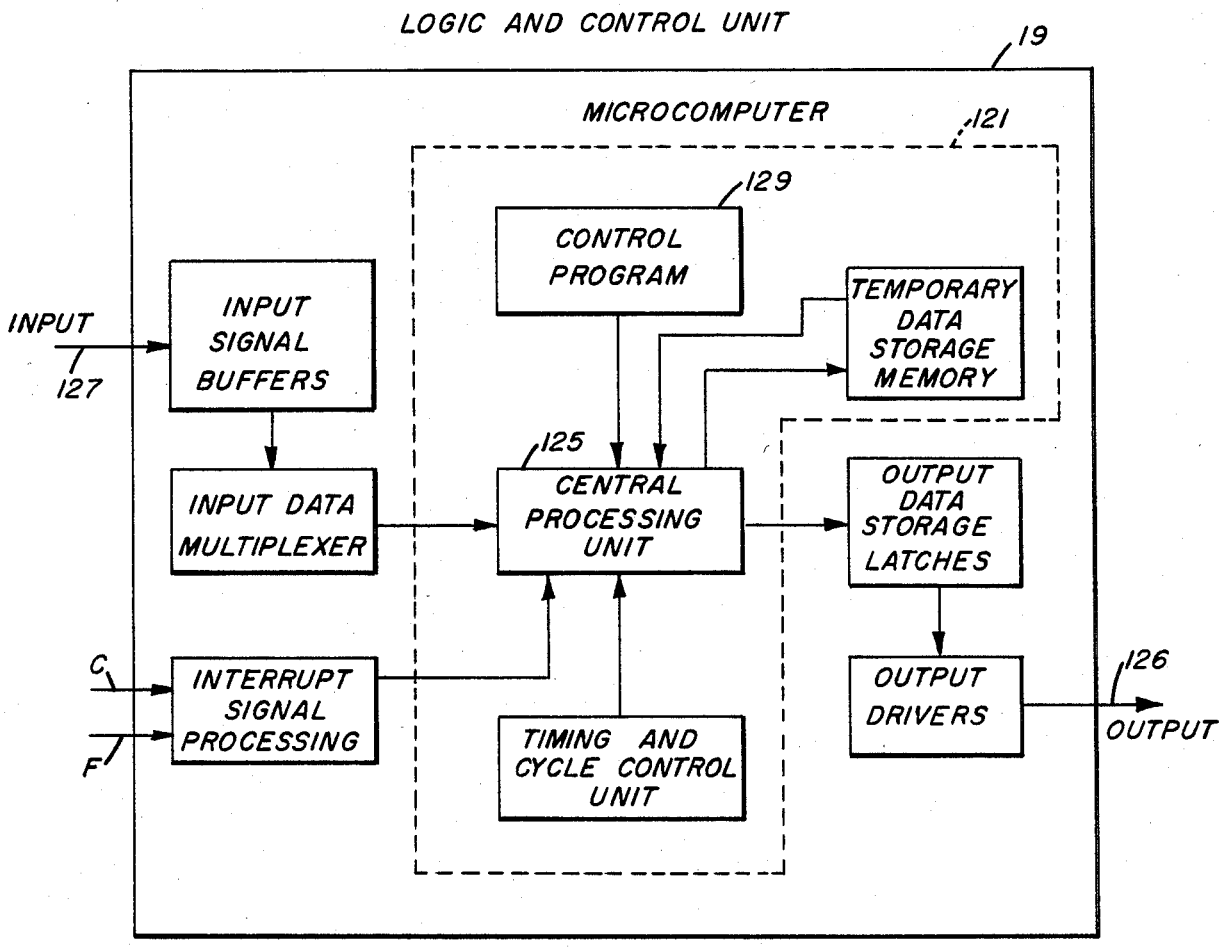
FIG. 2 is a diagram depicting generally a suitable logic and control unit for use with the copier represented in FIG. 1.

Logic and Control Unit (FIGS. 1 and 2)

The logic and control unit depicted in FIGS. 1 and 2 controls the various modes of operation, and coordinates the activities of the process section, the document feeding section, and the duplexing section. In the disclosed embodiment, a microcomputer 121 (FIG. 2) is utilized although other approaches, such as small and medium scale digital integrated circuits could accomplish similar functions. The combination and sequential logic requirements of the process are embedded in a control program 129 which provides instructions to a central processing unit 125 to control the state of output signals 126 based upon the states of input and timing signals 127, "C," and "F." The timing signals can be derived from an incremental encoder 128 (FIG. 1) connected to the drive means for the photoconductor drum, and provides information required to relate the position of the moving photoconductor to the positions of the fixed process stations.

The input and output signals are represented in FIG. 1 by reference characters 139–155. Taken in order, these characters identify control leads as follows:

139–142 lead to the document feeding section. Lead 139 actuates a drive, represented by dotted line D, for rotating the sheet propelling and inverting rollers 65, 81, 87 and 85. Leads 140 and 141 actuate clutches for selectively coupling the pick-off rollers 61 and 67 to the drive D, for and applying a vacuum source (not shown) to the bottom-most sheet in the document set. Lead 142 actuates the solenoid "S" for controlling the two positions of the registration gate 89 (raised and lowered or present and removed) for blocking or releasing sheets in the exposure position.

143–149, "C" and "F" lead to the process section and control its various stations for establishing and then tracking the visible representations on the photoconductor.

150–155 lead to the copy duplexing section. Lead 150 actuates the scuff feeder 105 for feeding a copy support in appropriate synchronism to receive the proper visible representation from the photoconductor. Leads 151 and 152 control the transfer and detacking coronas 99 and 101. Lead 153 controls the fuser 39. Lead 154 establishes the position of the diverter 104, and lead 155 actuates scuff feeder 119.

Of course additional and alternative leads could be applied as desired to effect the intended operation. Further descriptions of suitable control devices are presented in previously referenced U.S. Pat. No. 3,914,047, and in commonly assigned copending U.S. patent application, Ser. No. 671,865, entitled Original Document Rearrangement Apparatus for Use in Recirculating Feeders, filed on Mar. 30, 1976 in the name of M.G. Reid, et al, now Defensive Publication No. T957,006, published Apr. 5, 1977.

Under the influence of the logic and control unit, the presentation to the process section of the original and copy sheets, and their appropriate inversions, are coordinated so that the copies will be collated in the page-sequential order described above. In the collating mode of operation, for each presentation of an original sheet, one exposure is made to establish a visible representation of one face of that original sheet, and for each visible representation thus established, a copy-support face is presented to receive it. Thus, the original sheet and copy support faces are fed on a one-for-one basis. This is not to say that there are an equal number of original and copy sheets, which would not be the case, of course, when multiple copies are generated, but rather that there is one-for-one correspondence in the presentations of the respective sheet faces to the process section. Nor is it intended that the original and corresponding copy sheets must be fed at the same time. Generally, the feeding of an original sheet is displaced in time from the feeding of its corresponding copy sheet, either forward or backward, depending upon the machine configuration.

The logic and control unit also tracks the copies as they are made, and directs the document feeding and copy duplexing sections so that the first and second faces of the copies will properly correspond with the first and second faces of the original.

Offset stacking, stapling and other finishing operations have not been depicted. It is intended, however, that such apparatus be controlled for operation in synchronism with the copier, preferrably by the logic and control unit 9.

Overall Operation FIGS. 3–8

Figure 3:
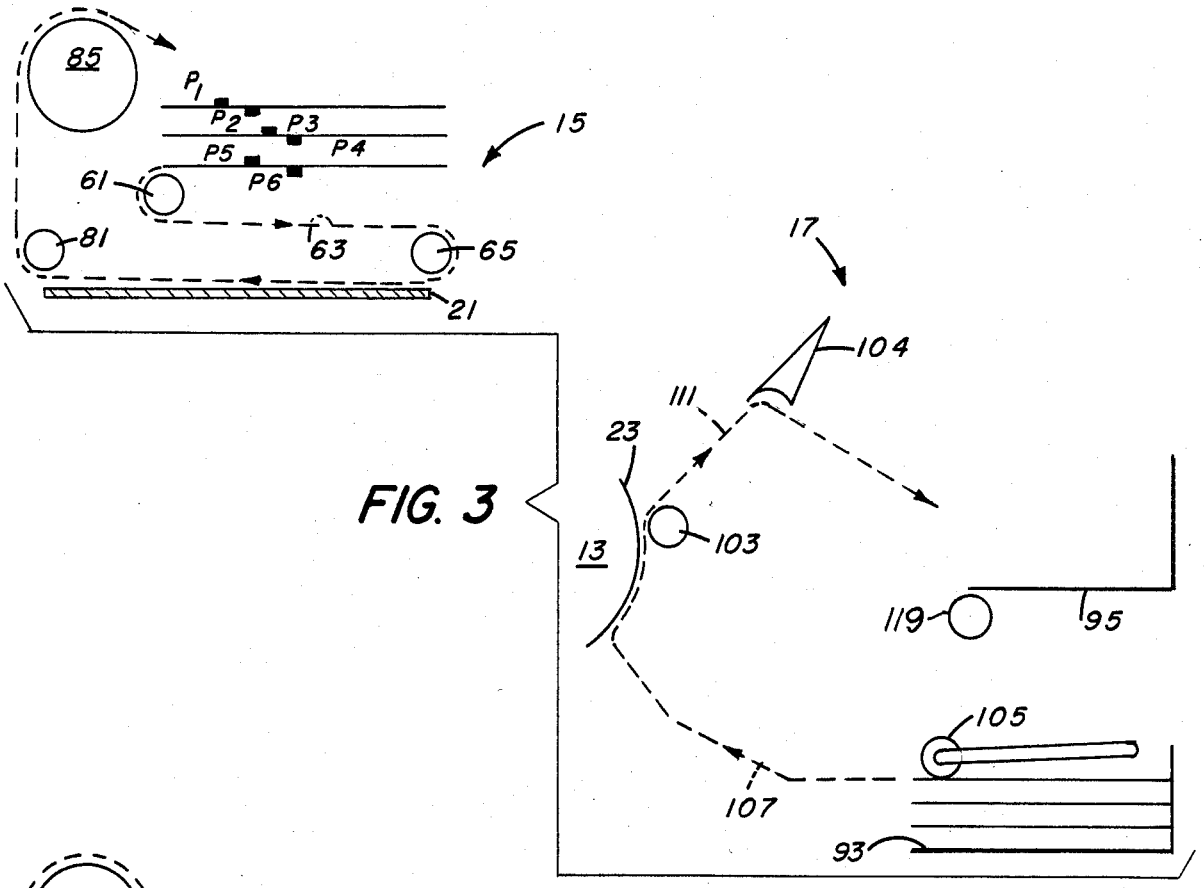
FIGS. 3–5 are schematic representations of a duplex-to-duplex mode of operation of the copier depicted in FIG. 1.
Figure 4:
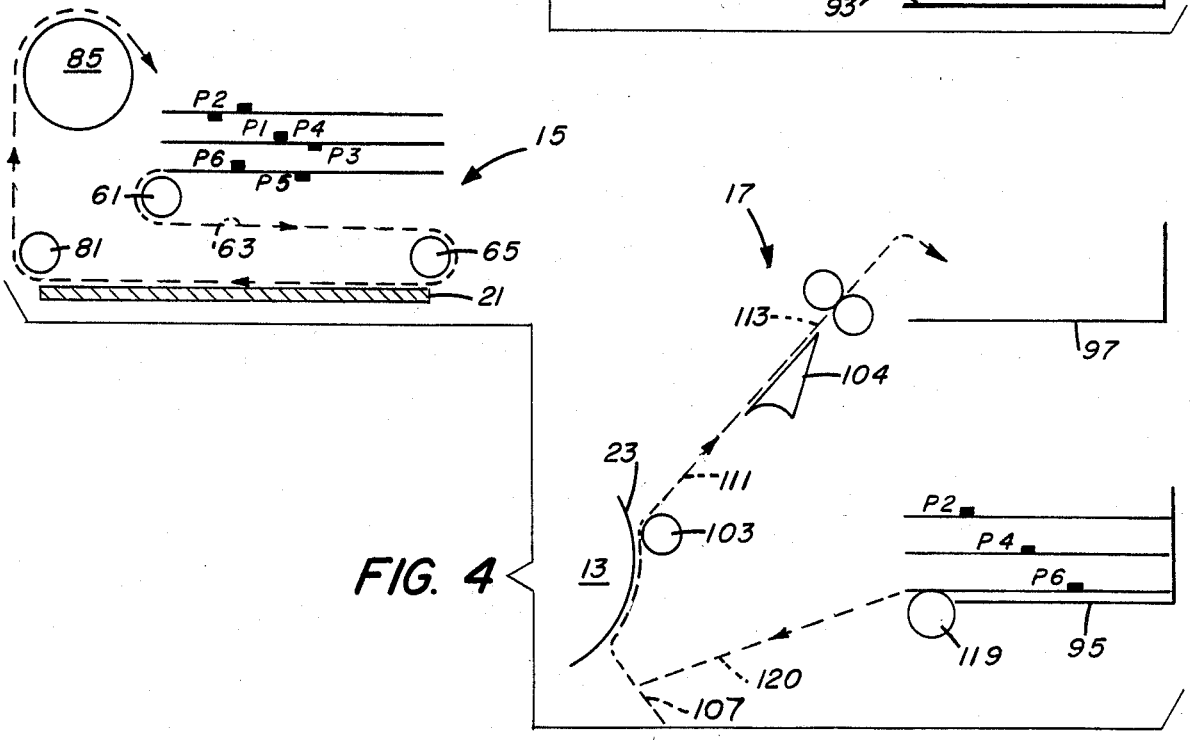
Figure 5:
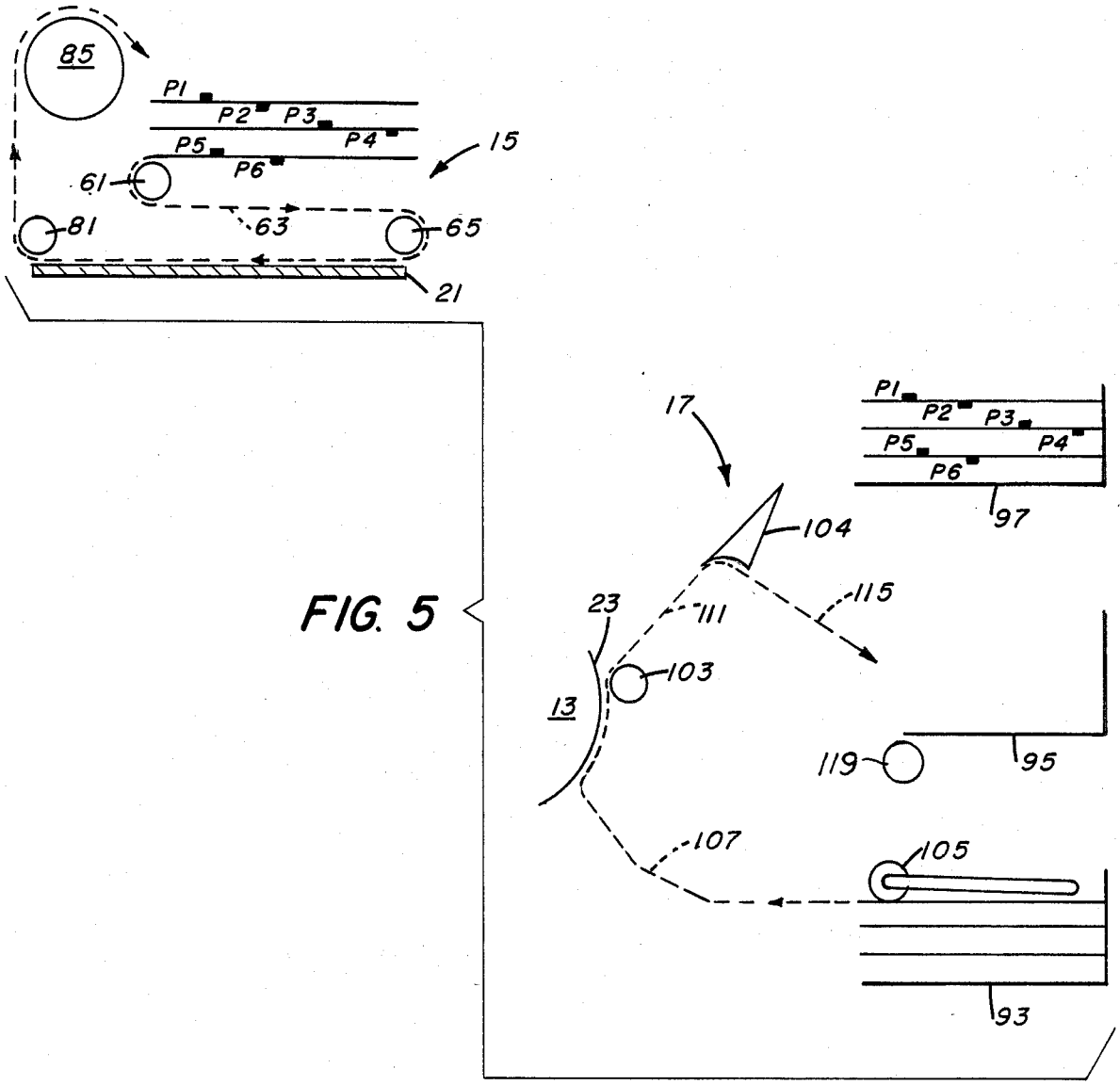

The duplex-to-duplex mode of operation is represented in FIGS. 3–5.

Referring first to FIG. 3, original document sheets are fed, one-after-another, from the bottom of an original set, to the process section for copying, and then to the top of the original set. The last sheet is fed first, and each sheet is inverted an even number of times in its path from the original set to the process section, and an odd number of times in its path from the process section back to the original set. In this manner, the even pages are removed from a downwardly facing orientation, copied in descending order (p.6, p.4, p.2) and returned in an upwardly facing orientation.

In the copy duplexing section, the copy sheets are fed, one-after-another, in synchronism with the original sheets, from a supply stack, to the process section and then to an intermediate station 95 with each sheet on top of previously delivered sheets. The copy sheets are thus delivered to the intermediate station in the same order and orientation that the original sheets are returned to the original set.

Referring next to FIG. 4, the odd pages are copied in descending order. Following the same path as in FIG. 3, the sheets are removed from the original set, where the odd pages were facing down, and returned to the set with the odd pages facing up. In the copy duplexing section, the copy sheets are fed from the intermediate station, to the process section, and then to an exit station after receiving the representations of pages p.5, p.3, and p.1 on the backs of the copy sheets already supporting pages p.6, p.4, and p.2 respectively. At the exit station, the sheets are delivered right-side up (page 1 on top) with each sheet on top of the previously delivered sheets in collated page-sequential order.

The process then proceeds, as depicted in FIG. 5, to alternately copy the even and odd pages of the original set until all of the copies are completed and delivered to the exit station.

Figure 6:
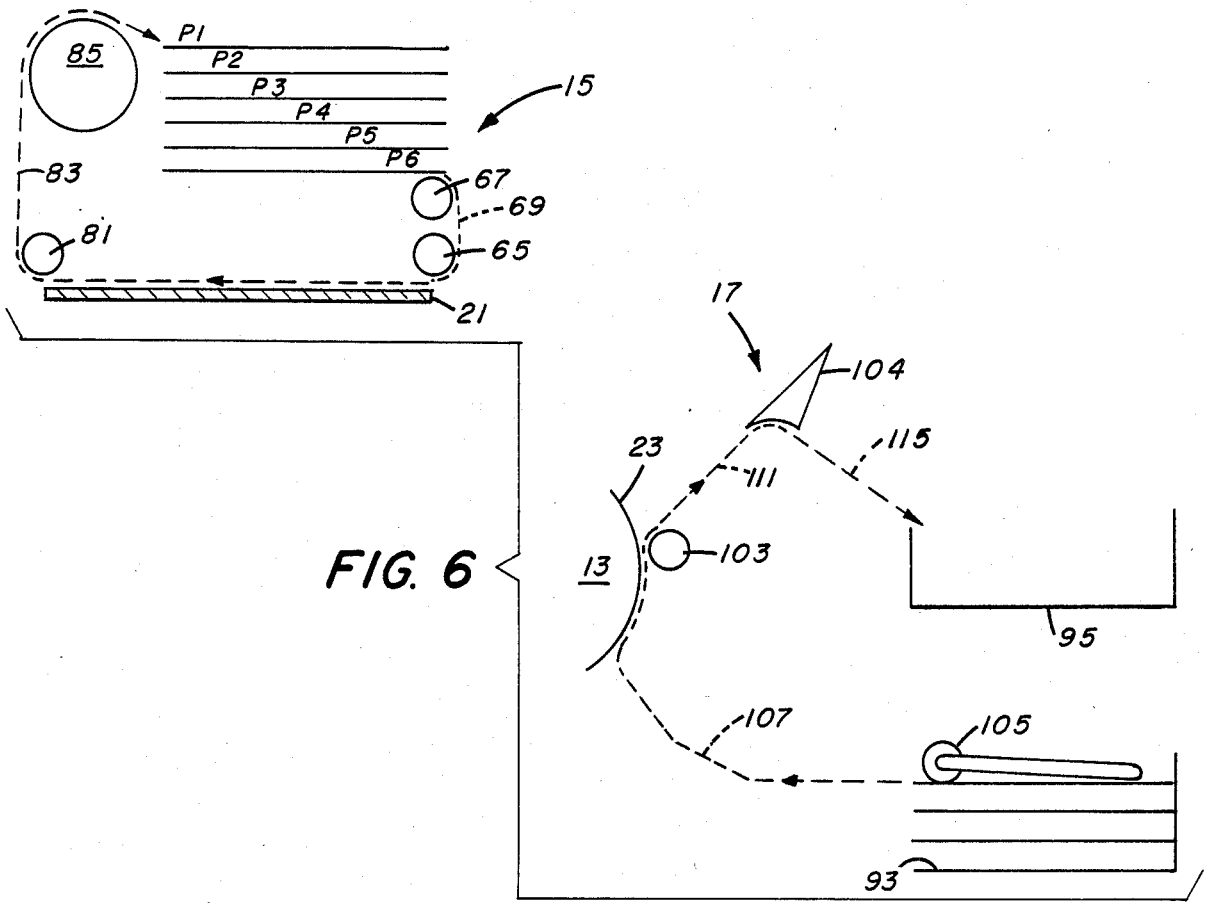
FIGS. 6–8 are schematic representations of a simplex-to-duplex mode of operation of the copier depicted in FIG. 1.
Figure 7:
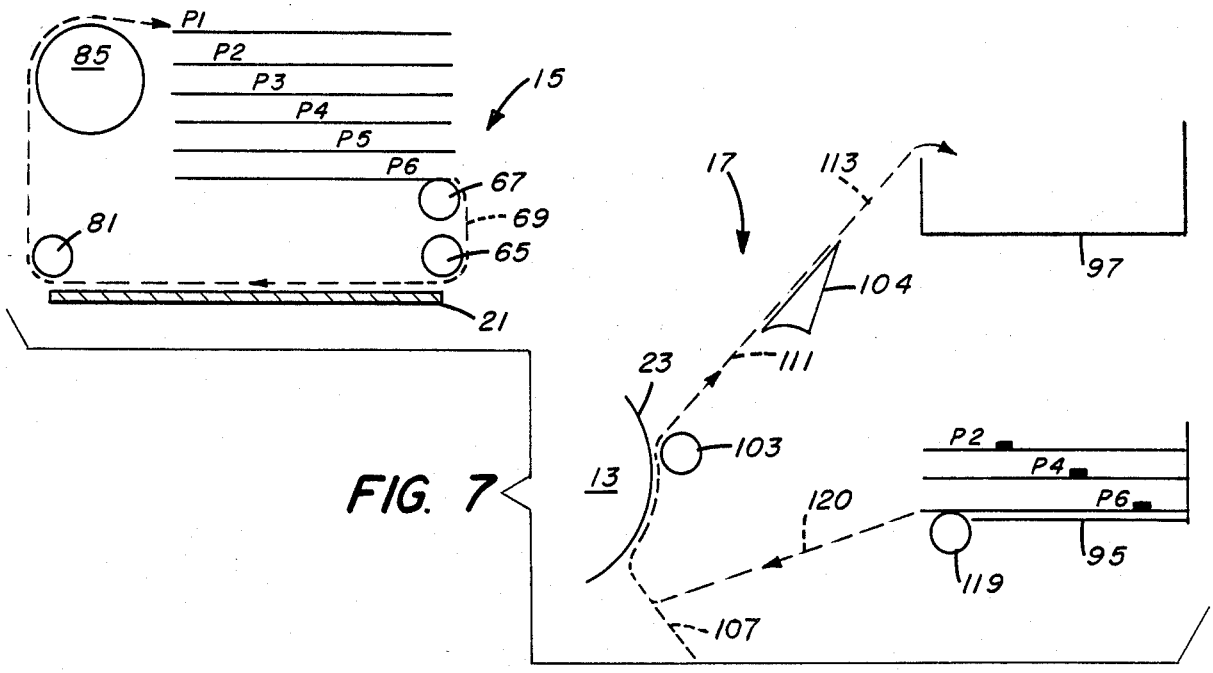
Figure 8:
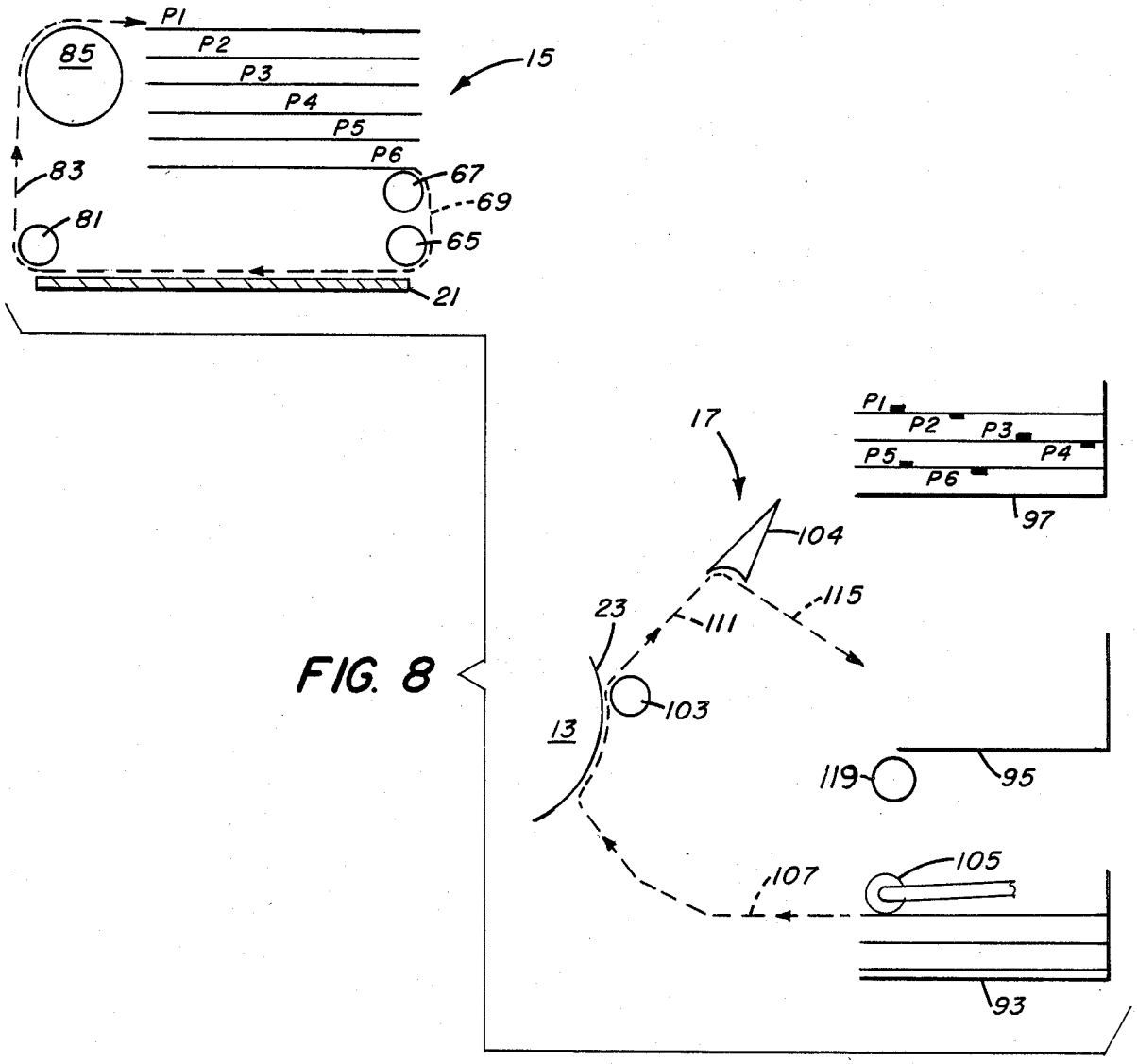

The simplex-to-duplex mode of operation is illustrated in FIGS. 6–8.

FIG. 6 depicts the copying of the even pages, FIG. 7 the odd pages, and FIG. 8 the subsequent copies. The copy duplexing section operates essentially the same in the simplex-to-duplex mode as it did in the duplex-to-duplex mode. The original document feeding section, on the other hand, directs the original sheets along the path 69 containing an odd number of sheet inversions, and the sheets are returned along path 83 to the original set. Thus the original sheets are returned in the same face-up orientation after each circulation. Only every other sheet is copied, and the copied sheets alternate, so that pages p.6, p.4 and p.2 will be copied on the first and every odd circulation of the original, pages p.5, p.3, and p.1 will be copied on the second and every even circulation of the original, and so forth until the desired number of copies are completed.

It should be understood that the present invention contemplates modes of operation that will account for the usual variations in originals. A duplex original that ends on the first face of the last sheet, for example, need not be copied on the blank face. In a similar respect, it should be recognized that all of the capabilities that are available in accordance with the present invention need not be used in every mode. Thus, the document feeder can have a non-collating mode and a simplex mode in addition to its collating duplex mode of operation.

Numerous advantages of the present invention now should be apparent to those skilled in the art. A collating document feeder is provided which inverts the original document sheets automatically without stopping the sheets during circulation to reverse their direction. First-copy time is reduced by completing both faces of the first copy before beginning the second copy. Especially attractive is the flexibility of the copier to render collated duplex or simplex copies from duplex or simplex originals, while retaining from earlier simplex-to-simplex devices the convenience of face-up, ordered handling of the original, in a single hopper, and similar face-up delivery of the copies to the final access position. Of course, various modifications are possible within the scope of the invention that may not employ its entire potential.

Although the invention has been described in detail with particular reference to preferred embodiments thereof, it will be readily understood that variations and modifications can be effected within the spirit and scope of the invention as described hereinabove and as defined in the appended claims.

I claim:

1. A feeder for presenting a set of simplex or duplex document sheets to a duplicating apparatus, the duplex sheets bearing information on first faces oriented in one direction relative to the set and second faces oriented in the opposite direction, and the simplex sheets bearing information only on first faces oriented in the same direction relative to the set, said feeder comprising:

a hopper for receiving a set of document sheets and having first and second exits through which individual sheets are removed;

means spaced from said hopper and defining an exposure position at which the document sheets are located one face at a time for copying by such duplicating apparatus; and means for circulating the set of plurality of times one-sheet-after-another, from said hopper to said exposure position and back to the set in said hopper, said circulating means including means for removing duplex sheets through said first exit and for presenting the second faces for copying in said exposure position on the first and every odd circulation of the set and for presenting the first faces for copying in said exposure position on the second and every even circulation of the set, and further including means for removing simplex document sheets through said second exit and for presenting the first faces in succession to said exposure position.

2. The invention of claim 1 and wherein said first and second exits are located at opposite ends of said hopper.

3. The invention of claim 1 and wherein said circulating means further comprises means for moving the sheets such that the edge of the sheets first passing through one of said exits is always the leading edge during a circulation of the set.

4. The invention of claim 3 and wherein said moving means further comprises means for moving the sheets back to the set at a position remote from said first and second exits, whereby the sequence of sheet position in the set is maintained.

5. The invention of claim 1 and wherein said hopper defines a surface for supporting the sheets in a substantially horizontal plane, and wherein said first and second exits ae located at opposed ends of said surface.

6. The invention of claim 5 and wherein said circulating means further comprises means for maintaining the edge of the sheets first removed from said first and second exits as the leading edge of the sheets during a circulation of the set, and means for moving the sheets back on top of the set in said hopper.

7. Duplicating apparatus for producing copies from a set of original sheets, the orignal sheets defining first and second faces, the copies including corresponding sets of individual supports having first and second faces, said apparatus comprising:

a feeder for the original sheets, said feeder including a feeder hopper for receiving the set of original sheets, the hopper having a first exit and a second exit through which original sheets can be removed from the hopper, the second exit being spaced from the first exit, means defining an exposure position spaced from said hopper at which the original sheets are located for copying, and means for circulating the set of original sheets a plurality of times from said hopper to said exposure position and back to said hopper, said circulating means including means for presenting the second faces of the original sheets for copying on the first and every odd circulation and for presenting the first faces of the original sheets for copying on the second and every even circulation, said circulating means comprising a first sheet path extending from said first exit to said exposure position configured to invert the original sheets an even number of times and a second sheet path extending from said exposure position back to said feeder hopper configured to invert the original sheets an odd number of times, and said circulating means further comprising a third sheet path extending from said second exit of said feeder hopper to said exposure position configured to invert the original sheets an odd number of times whereby the same face of an original sheet is presented for copying on each circulation of the set along the third sheet path and the second sheet path, and control means for directing the original sheets along the third sheet path and the second sheet path when the original sheets have information on only one face thereof that is to be copied and for directing the original sheets along the first sheet path and the second sheet path when the original sheets have information on both faces thereof that is to be copied;

a process section for establishing visible representations of the original faces presented in said exposure position;

a copy duplexing section having means for presenting and re-presenting the copy supports to said process section to receive the visible representations on the second and first faces of the copy supports, said presenting and re-presenting means including a support hopper for receiving a respective set of the copy supports between the presentation and re-presentation of the supports to said process section, means for delivering the supports to said support hopper with each support on top of previously delivered supports, and means for removing the supports from said support hopper with the first delivered support removed before later delivered supports; and a copy receiving hopper, means defining a first support path leading from said process section to said support hopper and a second support path leading from said process section to said copy receiving hopper, and means for selectively directing said copy supports along one of said paths leading to said support hopper or said receiving hopper.

8. Duplicating apparatus as set forth in claim 7 wherein said removing means of said copy duplexing section comprises a support feeder positioned under the support hopper for withdrawing supports one-after-another from the bottom of a set of supports in the support hopper and for directing such removed supports seriatim to the process section to receive respective second visible representations thereon.

9. Duplicating apparatus for producing multiple copies of a document, the document consisting of a set of individual sheets defining first and second faces and having on the first face thereof information to be copied, the copies including sets of individual sheets having first and second faces; said apparatus comprising:

a document feeder comprising a document hopper for receiving the set of document sheets with the first faces thereof facing upwardly, the hopper having an exit through which said sheets can be removed one-sheet-after-another, an exposure position at which the first face of a document sheet is presented for copying, means for circulating the set of document sheets a plurality of times, one-sheet-after-another, from the exit of the hopper to the exposure position for copying and then back to the hopper, said circulating means defining a first sheet path extending from the hopper exit to the exposure position configured to invert the document sheets an odd number of times, and said circulating means defining a second sheet path extending from the exposure position back to the hopper configured to invert the document sheet an odd number of times, thereby to present the same faces of the sheets for copying on successive circulations of the sheets to the exposure position;

a process section for extablishing visible representations of the document faces presented at said exposure position; and a copy duplexing section, said duplexing section including a supply hopper for receiving a supply of copy sheets, an intermediate hopper for storing copy sheets temporarily, an exit station for receiving the copy sheets, means for feeding the copy sheets one-after-aother (1) from said supply hopper to said process section to receive visible representations on the second faces of the copy sheets, (2) from said process section to said intermediate hopper to store the copy sheets temporarily, (3) from the bottom of a stack of copy sheets in the intermediate hopper to said process section to receive visible representations on the first faces of the copy sheets, and (4) then to said exit station, and control means for directing the document sheets along the first and second sheet paths twice for each complete set of copies of the document sheets that is to be produced, said control means being effective to operate the process section to copy alternate document sheets on the second faces of the copy sheets during the first circulation of the document sheets and to copy the other document sheets on the first faces of the copy sheets during the second circulation of the document sheets, whereby the first faces of the copy sheets receive information on the first faces of some document sheets and the second faces of the copy sheets receive information on the first faces of the other document sheets to effect simplex-to-duplex copying.

10. Duplicating apparatus for producing multiple copies of a set of simplex or duplex sheets, the duplex sheets bearing information on first faces oriented in one direction relative to the set and second faces oriented in the opposite direction, and the simplex sheets bearing information only on first faces oriented in the same direction relative to the set, said duplicating apparatus comprising:

a process section including an exposure station for establishing visible representations of the faces of document sheets presented at said exposure station;

a document feeder including a document hopper for receiving a set of document sheets and having first and second exits through which the sets are removed, means spaced from said document hopper and defining an exposure position in said exposure station at which the document sets are located one face at a time for copying, means for circulating the set a plurality of times one set after another from said document hopper to said exposure position and back to said document hopper, said circulating means including means for removing duplex sheets through said first exit, and for presenting the second faces for copying in said exposure position on the first and every odd circulation of the set and for presenting the first faces for copying in said exposure position on the second and every even circulation of the set, and further including means for removing simplex document sets through said second exit and for presenting the first faces in succession to said exposure position;

a copy duplexing section including a supply hopper for receiving a supply of copy sheets, an intermediate hopper for storing copy sheets temporarily, an exit station for delivering the copy sheets, and means for feeding the copy sheets one-after-another in synchronization with circulation of the document sheets, from said supply hopper to said process section to receive visible representations on the second faces of the copy sheets, from said process section to said intermediate hopper to store the copy sheets temporarily, from the intermediate hopper to said process section to receive visible representations on the first faces of the copy sheets, and then to said exit station; and control means for the process section comprising means effective when a set of duplex document sheets are in the document hopper for establishing a visible representation of the face of each successive sheet presented at said exposure station and means effective when a set of simplex sheets are in the document hopper for establishing a visible representation of the faces of the document sheets on alternate presentations at said exposure station.

11. Duplicating apparatus as set forth in claim 10 wherein the circulating means of the document feeder comprises means for moving the sheets such that the edge of the sheets first passing through one of said exits is always the leading edge during the first and successive circulations of the set, and said circulating means further comprises means for moving the sheets back to the set at a position remote from said first and second exits whereby the sequence of sheet position in the set is maintained.

12. Duplicating apparatus as set forth in claim 10 wherein the hopper defines a surface for supporting the sheets in a substantial horizontal plane and wherein said first and second exits are located at opposed ends of said surface, and said circulating means further comprises means for maintaining the edge of the sheets first removed from said first and second exits as the leading edge of the sheets during circulation of the set.

13. A collating feeder for presenting seriatim to a copying apparatus a set of document sheets having first and second faces, said feeder comprising:

a hopper for receiving the set of sheets, the hopper having a first exit and a second exit at the bottom thereof through which sheets can be removed;

means defining an exposure position which is spaced from said hopper and at which the sheets are located for copying; and means for circulating the set a plurality of times, one-sheet-after-another, from the bottom of said hopper directly to said exposure position for copying and then directly back to the top of said hopper, said circulating means defining (1) a first sheet path leading from said first exit of the hopper and configured to invert the sheets an odd number of times between the hopper and the exposure position when only one face of each sheet is to be presented to the exposure position for copying, (2) a second sheet path leading from said second exit of the hopper and configured to invert the sheets an even number of times between the hopper and the exposure position when both faces of the sheets are to be presented to the exposure position for copying, and (3) a third sheet path configured to invert the sheets once when the sheets are returned to the top of said hopper from said exposure position, said circulating means comprising means for moving the document sheets such that the edge of the sheets first passing through one of the exits continues to be the leading edge during each circulation of the set.

14. A collating feeder for presenting seriatim to a copying apparatus a set of document sheets having first and second faces, said feeder comprising:

a hopper for receiving the set of sheets, the hopper having first and second opposed exit slots located at opposite ends of the hopper;

means defining an exposure position which is spaced from said hopper and at which the sheets are located for copying; and means for circulating the set a plurality of times, one-sheet-after-another, from the bottom of said hopper directly to said exposure position for copying and then directly back to the top of said hopper, said circulating means defining (1) a first sheet path communicating with the first exit slot and configured to invert the sheets an odd number of times between the hopper and the exposure position when only one face of each sheet is to be presented to the exposure position for copying, (2) a second sheet path communicating with the second exit slot and configured to invert the sheets an even number of times between the hopper and the exposure position when both faces of the sheets are to be presented to the exposure position for copying, and (3) a third sheet path configured to invert the sheets once when the sheets are returned to the top of said hopper from said exposure position, and the circulating means further comprising sheet removing means adjacent said exit slot for removing the bottom sheet from the hopper and for feeding a removed sheet into said first or said second sheet paths.

15. A document feeder for presenting seriatim to a copying apparatus a set of document sheets having first and second faces, said feeder comprising:

a support having a sheet supporting floor for receiving the set of document sheets, said support having a first exit and a second exit spaced from each other;

means defining an exposure position which is spaced from said floor and at which the sheets are located for copying; and means for circulating the set a plurality of times, one-sheet-after-another, from said support to said exposure position for copying and back to said support, said circulating means defining (1) a first sheet path extending from said first exit of said support directly to said exposure position and configured to invert the document sheets an even number of times, (2) a second sheet path extending from said exposure position directly back to said support and configured to invert the document sheets once, whereby alternate faces of the sheets are presented for copying on successive circulations of the set, and (3) a third sheet path extending from said second exit of said support to said exposure position configured to invert the document sheets an odd number of times whereby a set of document sheets circulated along the third sheet path and the second sheet path present the same face of a document sheet for copying on each circulation of the document set.

* * * * *